US006076488A

United States Patent [19]

Yamagishi

[11] Patent Number: 6,076,488

[45] Date of Patent: Jun. 20, 2000

[54] COOLING DEVICE FOR A CONSTRUCTION MACHINE

[75] Inventor: Yoshinori Yamagishi, Kobe, Japan

[73] Assignee: Shin Caterpillar Mitsubishi Ltd., Japan

[21] Appl. No.: 09/065,111

[22] PCT Filed: Mar. 17, 1997

[86] PCT No.: PCT/JP97/00835

§ 371 Date: Apr. 24, 1998

§ 102(e) Date: Apr. 24, 1998

[87] PCT Pub. No.: WO98/09025

PCT Pub. Date: Mar. 5, 1998

[51] Int. Cl.[7] ..... F01P 7/02; F01P 7/10

[52] U.S. Cl. ..... 123/41.12; 123/41.31; 123/41.49

[58] Field of Search ..... 123/41.12, 41.11, 123/41.49, 41.31

[56] References Cited

U.S. PATENT DOCUMENTS

| | | | |
|---|---|---|---|
| 4,168,456 | 9/1979 | Isobe | 318/471 |
| 4,327,674 | 5/1982 | Takei | 123/41.12 |
| 4,409,933 | 10/1983 | Inoue | 123/41.12 |
| 4,664,074 | 5/1987 | Otani et al. | 123/41.31 |
| 4,738,330 | 4/1988 | Suzuki et al. | 180/421 |
| 4,774,910 | 10/1988 | Aihara et al. | 123/41.12 |
| 4,941,437 | 7/1990 | Suzuki et al. | 123/41.12 |
| 4,977,862 | 12/1990 | Aihara et al. | 123/41.12 |
| 5,018,484 | 5/1991 | Naitoh | 123/41.12 |
| 5,144,916 | 9/1992 | Yoshida et al. | 123/41.12 |
| 5,505,165 | 4/1996 | Kimoto | 123/41.12 |
| 5,609,125 | 3/1997 | Ninomiya | 123/41.12 |
| 5,828,967 | 10/1998 | Ueda | 701/1 |

*Primary Examiner*—Noah P. Kamen
*Assistant Examiner*—Hai Huynh
*Attorney, Agent, or Firm*—Morrison Law Firm

[57] ABSTRACT

A radiator (12*a*) and an oil cooler (12*b*) are disposed separately from an engine (11) of a construction machine and cooled by a cooling fan (15). The oil cooler (12*b*) is located downstream from the radiator (12*a*) with respect to the air flow generated when the cooling fan (15) is driven in reverse. A hydraulic motor (32) is adapted to be controlled by a directional control solenoid valve (34) of a fan driving circuit (31) so that the cooling fan (15) may be stopped, rotated forward or rotated in reverse accordingly. The directional control solenoid valve (34) is adapted to be automatically switched by a control device (41) having temperature sensors (44), (45), (46). The control device (41) is adapted to rotate the cooling fan (15) in reverse in cases where the temperature of the cooling water is not lower than a given temperature while the temperature of the hydraulic oil is lower than a given temperature, thereby causing the warm air which has passed the radiator (12*a*) to warm the hydraulic oil in the oil cooler (12*b*) and also causing back flow of the air to discharge debris lodged in the radiator (12*a*) and other components.

4 Claims, 5 Drawing Sheets

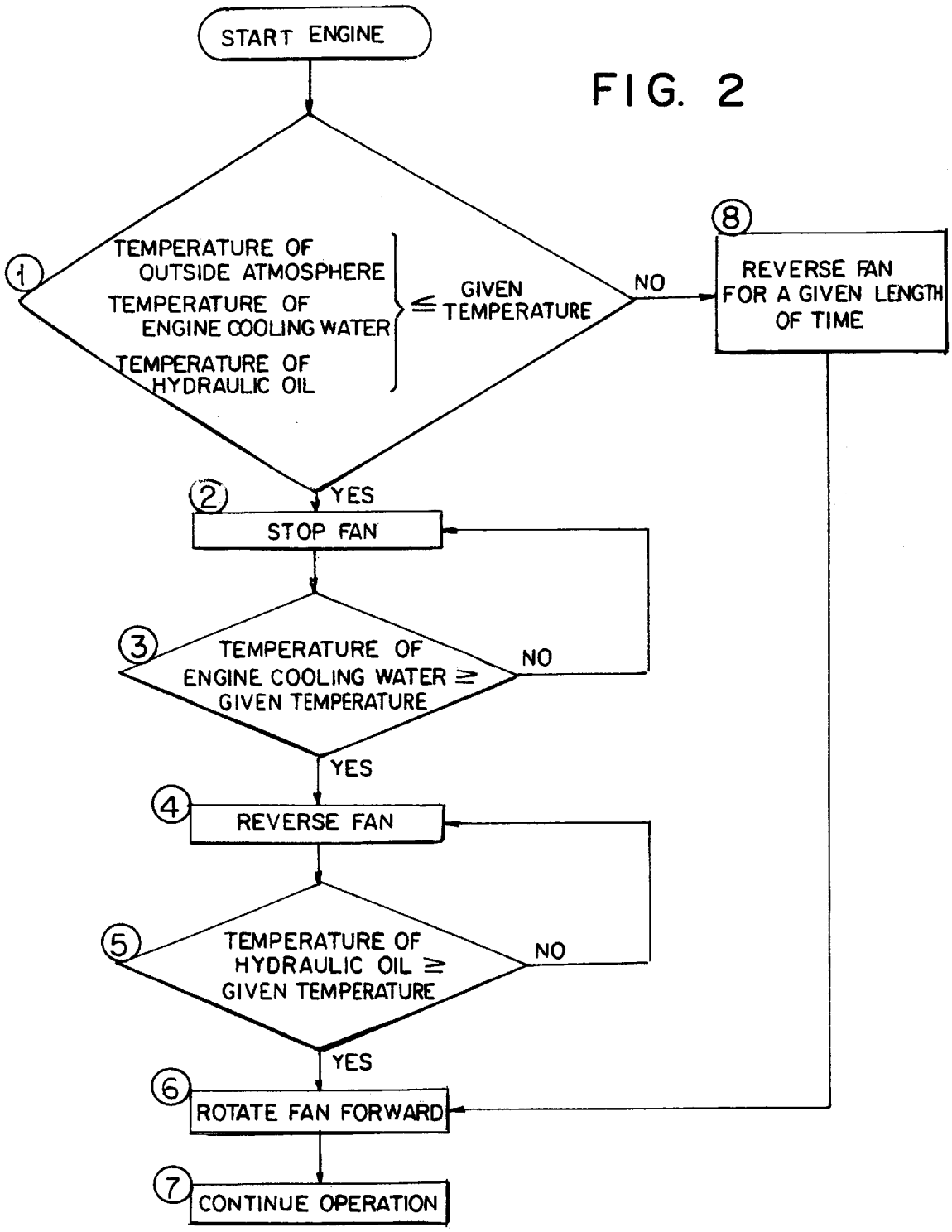
START ENGINE
FIG. 2
1
TEMPERATURE OF OUTSIDE ATMOSPHERE
TEMPERATURE OF ENGINE COOLING WATER
TEMPERATURE OF HYDRAULIC OIL
≤ GIVEN TEMPERATURE
NO
8
REVERSE FAN FOR A GIVEN LENGTH OF TIME
YES
2
STOP FAN
3
TEMPERATURE OF ENGINE COOLING WATER ≥ GIVEN TEMPERATURE
NO
YES
4
REVERSE FAN
5
TEMPERATURE OF HYDRAULIC OIL ≥ GIVEN TEMPERATURE
NO
YES
6
ROTATE FAN FORWARD
7
CONTINUE OPERATION

COOLING DEVICE FOR A CONSTRUCTION MACHINE

TECHNICAL FIELD

The present invention relates to a cooling device for a construction machine, such as a hydraulic excavator or a wheel loader.

BACKGROUND ART

When cooling the engine and the radiator of a construction machine, such as a hydraulic excavator, a wheel loader or the like, cooling air is usually supplied by way of driving, together with the engine, a fan which is directly connected to the engine. This system, however, requires an aperture sufficiently large for introducing and discharging the cooling air, and, therefore, there are limitations in how well the sound of the engine can be insulated. In order to solve the above problem, a configuration shown in FIG. 4 adapted to be disposed on the revolving super structure of a hydraulic excavator, wherein an engine 11 is disposed separately from a cooling unit 12 comprised of a radiator and an oil cooler, and an engine room 13 is enclosed in a sound insulating enclosure 14. According to this configuration, cooling air is supplied to the radiator and the oil cooler by driving an exclusive cooling fan 15 of the cooling unit 12.

FIG. 5 shows an example of conventional configurations for driving a cooling fan 15 disposed in an air passage 16 by means of a hydraulic motor 17, wherein the hydraulic motor 17 is driven only in the forward direction by means of hydraulic oil supplied from a hydraulic pump 18, which is rotated by an engine 11.

A radiator 12*a*, which is one of the two principal components of a cooling unit 12, is connected to a water jacket (not shown) of the engine 11 via a cooling water output pipe 21 and also connected to a water pump (not shown) of the engine 11 via a cooling water return pipe 22. An oil cooler 12*b*, which is the other principal component of the cooling unit 12, is adapted to the cool hydraulic oil that becomes hot as it circulates in a hydraulic circuit. The hydraulic circuit is comprised of a hydraulic pump 23 rotated by the engine 11, hydraulic equipment such as a control valve 24 for controlling the direction and the flow rate of the hydraulic oil discharged from the hydraulic pump 23, and a hydraulic actuator 25 which may be a hydraulic cylinder and is adapted to be operated by means of the hydraulic oil controlled by the control valve 24. The oil cooler 12*b* is disposed in a tank line 27 that extends from an oil discharge port of the control valve 24 to a tank 26.

In either one of the direct-connection system and the separate installation system described above, the cooling fan is rotated only in one direction so that the cooling air, too, flows in one direction, either for discharge or intake.

Particularly in cases where a cooling fan is directly connected to an engine, a revolution speed of the fan is normally in proportion to the engine speed, and cooling air is supplied to the cooling unit even immediately after starting the engine, when the temperatures of the engine cooling water, the hydraulic oil and the like have not yet reached the warm-up temperature appropriate for operation of the machine. Feeding cooling air in such a situation further increases the length of time of warm-up operation.

As the cooling air is fed only in one direction, dead leaves, debris or the like tend to enter the radiator and the oil cooler and often plug them.

In an effort to solve the above problems, the inventor of the present invention has focused on the fact that the radiator and the oil cooler respectively obtain cooling air for their own by driving their own dedicated cooling fans. Accordingly, an object of the present invention is to reduce the duration of a warm-up operation of the hydraulic equipment by means of reversing the rotation direction of the cooling fans and discharge debris stuck in the radiator or the oil cooler by using air blowing in the reverse direction.

DISCLOSURE OF INVENTION

A cooling device according to the present invention is a construction machine cooling device including a radiator and an oil cooler which are disposed separately from an engine and subject to forced cooling by a cooling fan, the radiator having a function of cooling the cooling water for the engine, and the oil cooler having a function of cooling the hydraulic oil for the hydraulic equipment, wherein said cooling device further includes a fan driving circuit which may be a hydraulic circuit, an electrical circuit or the like and is capable of selectively switching the mode of operation of the cooling fan so that the cooling fan may be stopped, rotated forward or rotated in reverse.

By reversing the rotation of the cooling fan as described above, debris lodged in the radiator and the oil cooler can be removed by back flow of the cooling air.

A cooling device for a construction machine according to another feature of the invention is a construction machine cooling device including a radiator and an oil cooler which are disposed separately from an engine and subject to forced cooling by a cooling fan, the radiator having a function of cooling the cooling water for the engine, and the oil cooler having a function of cooling the hydraulic oil for the hydraulic equipment, wherein said cooling device further includes a fan driving circuit which is capable of switching the mode of operation of the cooling fan so that the cooling fan may be stopped, rotated forward or rotated in reverse, and a control device adapted to switch the mode of operation of the cooling fan based on the temperature of the outside air, the temperature of the cooling water and the temperature of the hydraulic oil so that the cooling fan may be stopped, rotated forward or rotated in reverse accordingly. Therefore, in accordance with the temperature of the outside air, the temperature of the cooling water and the temperature of the hydraulic oil, the control device automatically switches over the fan driving circuit from among the three modes of operation: standstill, forward rotation and reverse rotation.

According to yet another feature of the invention, the direction of rotation of the cooling fan of a construction machine cooling device may be changed over by manual operation.

With the configuration as above, according to an arbitrary decision made by the operator of the construction machine based on conditions of clogging of the radiator and the oil cooler, the cooling fan may be driven in reverse by means of switching the fan driving circuit of the cooling fan by manual operation.

According to yet another feature of the invention, the oil cooler of a construction machine cooling device is located downstream from the radiator with respect to the air flow generated when the cooling fan is driven in reverse, and the control device is adapted to maintain the cooling fan at a standstill even after the engine is started in cases where the temperatures of the outside air, the cooling water and the hydraulic oil are all lower than the respectively given temperatures, rotate the cooling fan in reverse in cases where the temperature of the hydraulic oil is lower than a given temperature in the state where the temperature of the cooling water is not lower than a given temperature, thereby warming up the hydraulic oil in the oil cooler by using the warm air that has passed the radiator, and, when the temperatures of the cooling water and the hydraulic oil have both reached or exceed their respective given temperatures, rotate the cooling fan forward, thereby cooling both cooling water and hydraulic oil.

With the configuration as above, when the temperature of the hydraulic oil is low, the cooling device rotates the cooling fan in reverse so that the heat of the engine cooling water, which is flowing in the radiator and can be warmed with relative ease and more quickly, can be used for various purpose: warming up the hydraulic oil in the oil cooler, which is located downstream of the radiator when the oil cooler is driven in reverse; warming up the hydraulic equipment; and removing debris lodged in the radiator and the oil cooler by using back flow of the cooling air.

When the temperature of the outside air, the temperature of the cooling water or the temperature of the hydraulic oil is higher than a temperature specifically given therefor, the control device of a construction machine cooling device according to yet another feature of the invention reverse rotates the cooling fan for a given length of time after the engine is started and thereafter rotates same in the forward direction.

As a result of the reverse rotation of the cooling fan after the start of the engine, debris lodged in the radiator and the oil cooler is removed by means of back flow of the cooling air.

BRIEF DESCRIPTION OF DRAWINGS

FIG. 2 is a flow chart of the control process of said cooling device;

BEST MODE FOR CARRYING OUT THE INVENTION

Figure 3:
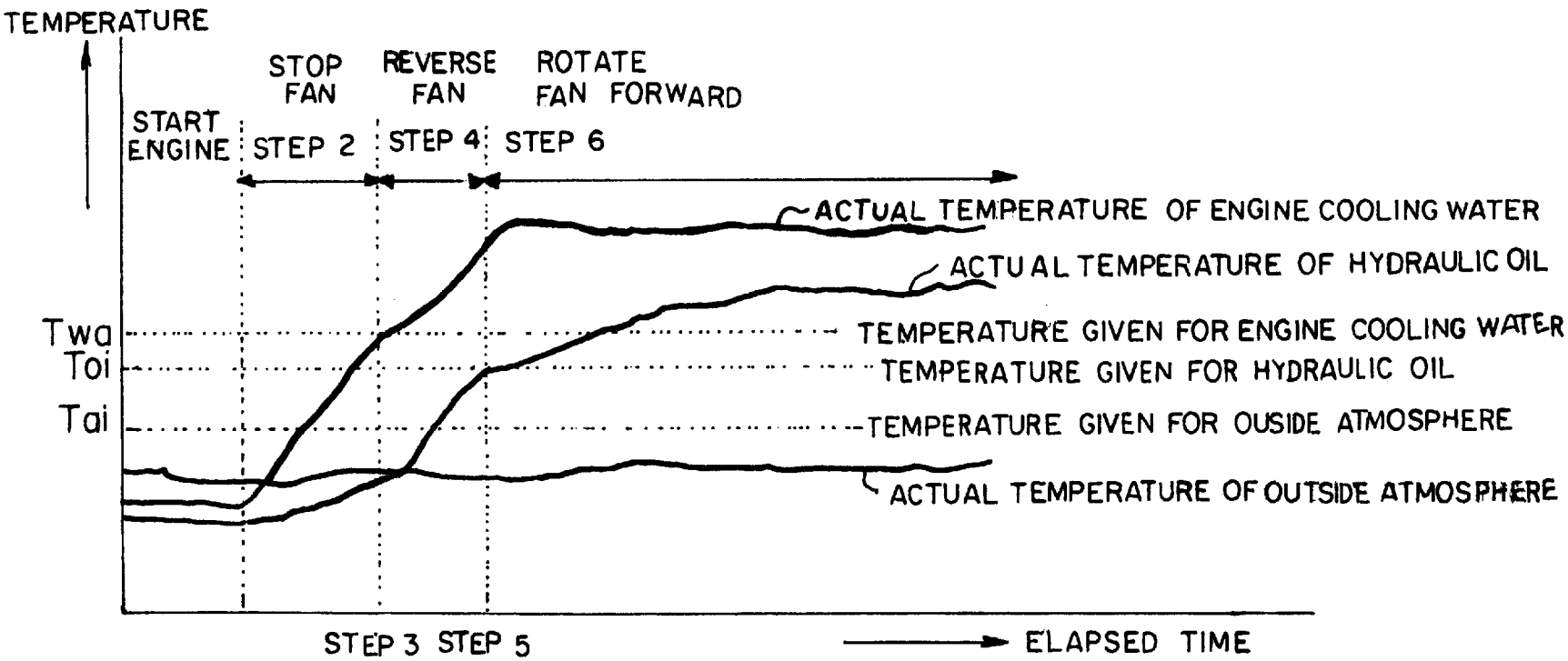
FIG. 3 is a temperature time characteristic diagram showing the timing for the operation of same.
Figure 4:
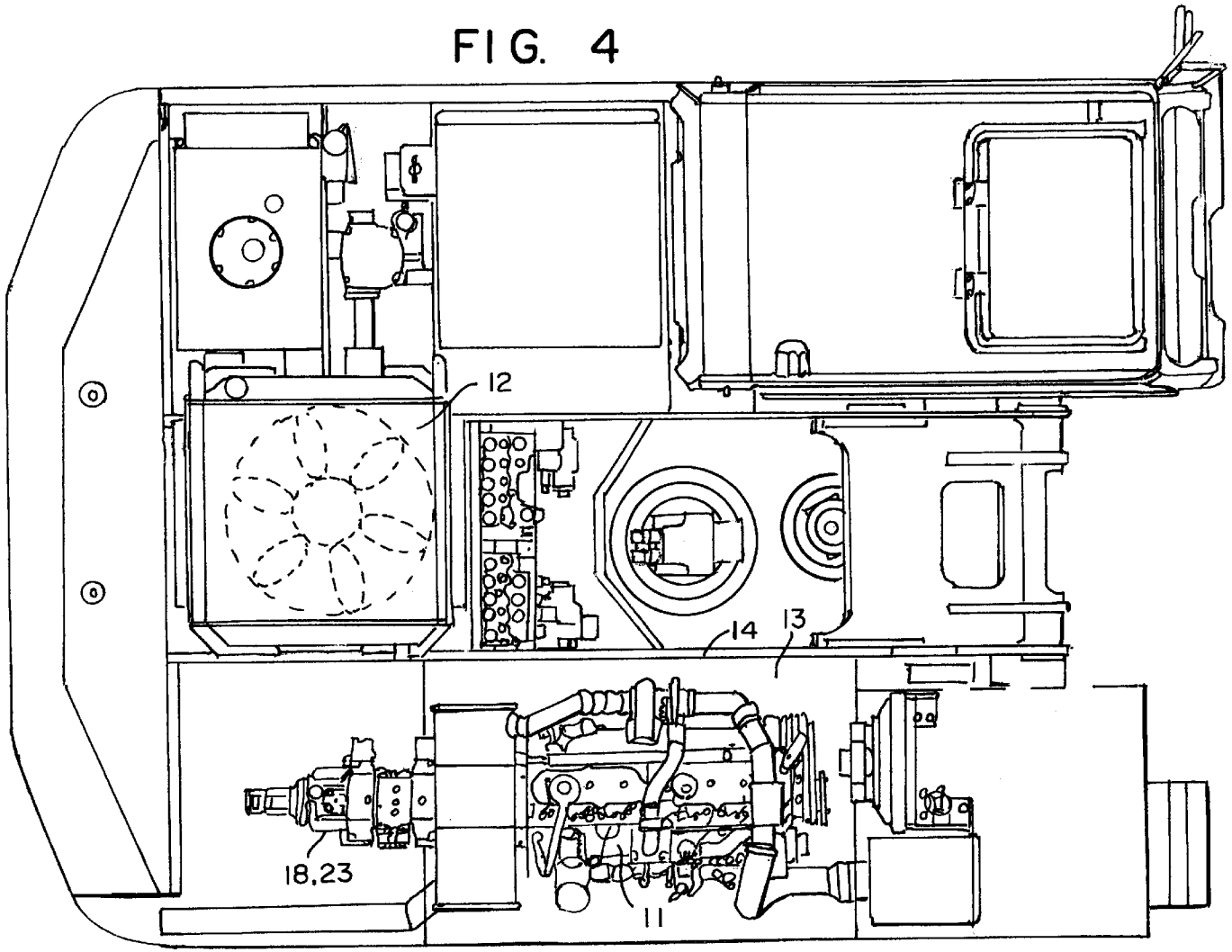
FIG. 4 is a top view showing arrangement of an engine, a cooling unit, etc. of a hydraulic excavator.
Figure 5:
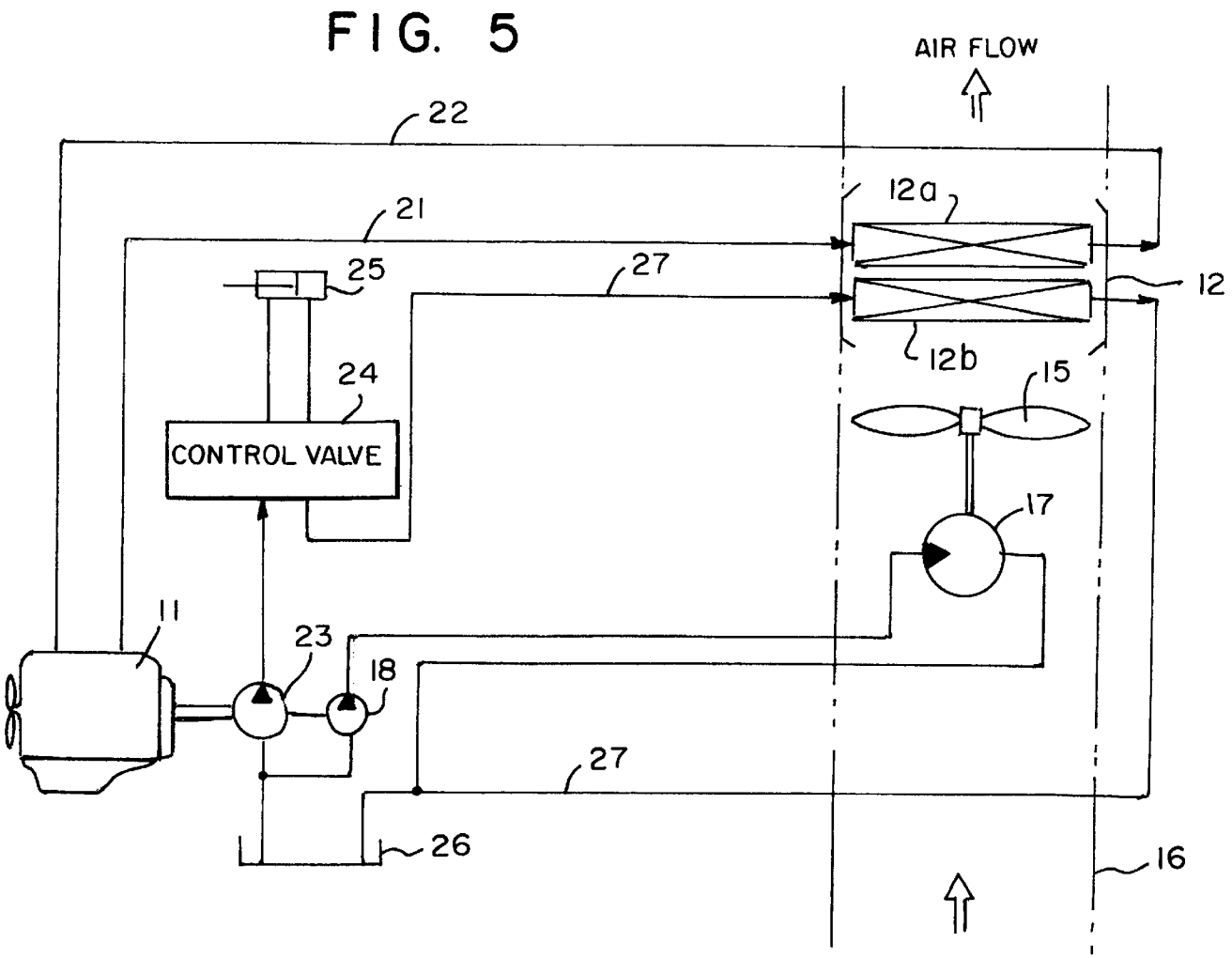
FIG. 5 is a circuit diagram of a conventional cooling device of a construction machine.

Next, the configuration of an embodiment of the invention is explained hereunder, referring to FIGS. 1 through 4. According to the present embodiment, the arrangement of such components as an engine 11 and a cooling unit 12 shown in FIG. 4 is the same as a conventional configuration. A hydraulic circuit is formed by hydraulic equipment for controlling a travelling system, a working equipment system, and so forth of a hydraulic excavator or the like, said hydraulic equipment being principally comprised of a control valve 24 and a hydraulic actuator 25 such as a hydraulic cylinder. As the hydraulic circuit described above has the same structure as that of a conventional hydraulic circuit shown in FIG. 5, elements corresponding to those shown in FIG. 5 are identified with same reference numerals, the explanation of which is omitted hereunder.

Figure 1:
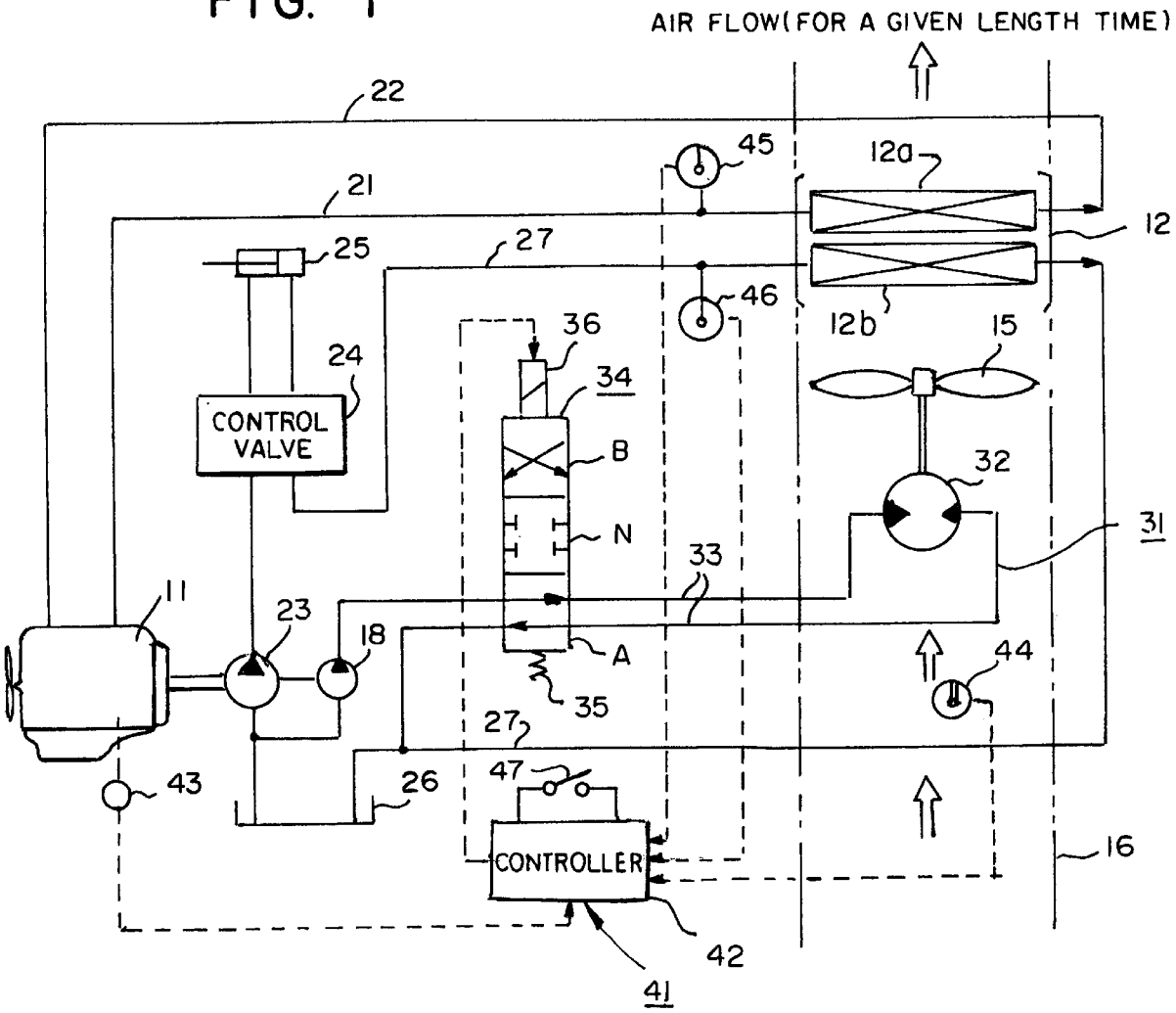
FIG. 1 is a circuit diagram of a cooling device of a construction machine according to an embodiment of the present invention.

As shown in FIG. 1, the cooling unit 12 disposed separately from an engine 11 is comprised of a radiator 12*a*, an oil cooler 12*b* and a cooling fan 15 disposed below the radiator 12*a* and the oil cooler 12*b*. The radiator 12*a* is adapted to cool the cooling water for engine 11, and the oil cooler 12*b* is adapted to cool the hydraulic oil for operating the hydraulic equipment. The radiator 12*a* serves to cool the cooling water for the engine 11. The cooling fan 15 serves to provide forced cooling to these components.

The oil cooler 12*b* is located upstream from the radiator 12*a* with respect to the air flow generated when the cooling fan 15 is driven in the normal direction. In other words, the oil cooler 12*b* is located downstream from the radiator 12*a* with respect to the air flow generated when the cooling fan 15 is driven in reverse.

FIG. 1 shows an example of configuration wherein the cooling fan 15 is associated with a hydraulic fan driving circuit 31 which is capable of selectively driving the cooling fan 15 so that the cooling fan 15 can be stopped or driven in normal rotation or reverse rotation.

The fan driving circuit 31 includes a hydraulic pump 18 adapted to be rotated by the engine 11, a hydraulic motor 32 which is capable of revolving in either direction, i. e. normal or reverse, and adapted to be operated by hydraulic oil fed from the hydraulic pump 18, and a directional control solenoid valve 34 disposed in a hydraulic pipe line 33 that connects the hydraulic pump 18 and a tank 26 respectively to two ports of the hydraulic motor 32.

The directional control solenoid valve 34 of the fan driving circuit 31 is a 3-position 4-port change valve having a neutral position N for stopping the fan, a normal position A for rotating the fan forward, in other words in the normal direction, and a reverse position B for rotating the fan in reverse and is adapted to stop or rotate the hydraulic motor 32 forward or in reverse. To be more specific, in order to stop or rotate the hydraulic motor 32 forward or in reverse, the directional control solenoid valve 34 is adapted to move its spool valve element according to the power relationship between the return force of a return spring 35 and the axial thrusting force generated on a solenoid 36, thereby cutting off or controlling the direction of the flow of the hydraulic oil fed from the hydraulic pump 18 to the hydraulic motor 32.

A control device 41 for controlling the mode of operation of the cooling fan is provided in association with the directional control solenoid valve 34 described above. The control device 41 is adapted to automatically shift the position of the directional control solenoid valve 34 based on the temperature of the outside air, the temperature of the cooling water for the engine and the temperature of the hydraulic oil when the engine is started and during the operation of the engine. The control device 41 includes a controller 42 as the principal component. An engine speed sensor 43 for detecting the number of revolution of the engine 11, an outside air temperature sensor 44 for detecting the temperature of the outside air, a cooling water temperature sensor 45 for detecting the temperature of the cooling water for the engine, and a hydraulic oil temperature sensor 46 for detecting the temperature of the hydraulic oil are connected to an input terminal of the controller 42. The cooling water temperature sensor 45 is disposed in the cooling water output pipe 21, and the hydraulic oil temperature sensor 46 is disposed in front of the oil cooler 12*b* in the hydraulic circuit. An output terminal of the controller 42 is connected to the solenoid 36 of the directional control solenoid valve 34.

Provided in association with the control device 41 is a manual switch 47 adapted to stop automatic control, which is conducted based on values detected by the respective sensors, and enable the cooling fan 15 to be rotated in reverse by manually shifting the directional control solenoid valve 34 to the reverse position B.

In case of the embodiment described above, the fan driving circuit 31 for driving the cooling fan 15 is formed by a hydraulic circuit. However, as another embodiment (not shown in the drawings), a fan driving circuit which is capable of switching rotation of the cooling fan 15 to a standstill, forward rotation or reverse rotation may be formed by an electrical circuit whose power source may be a generator driven by the engine 11 or a large battery mounted on a vehicle.

For example, a 2-way electric motor which can be driven in reverse may be used instead of a hydraulic motor 32. In this case, an electromagnetic change-over switch adapted to be operated by an electromagnetic coil and function as a switching means for switching rotation of the electric motor to a standstill, forward rotation or reverse rotation may be conveniently provided in the circuit adapted to feed electric power to the electric motor, said electromagnetic coil of the electromagnetic change-over switch connected to a control device adapted to automatically operate the electromagnetic change-over switch based on the temperature of the outside air, the temperature of the cooling water for the engine and the temperature of the hydraulic oil when the engine is started and during the operation of the engine. In case of this electric circuit, too, a manual switch may be desirably included in the control device so that the electromagnetic change-over switch can also be manually operated by means of the manual switch.

Next, the function of the embodiments is described hereunder, referring to the flow chart shown in FIG. 2 and the temperature-time characteristic diagram shown in FIG. 3. In FIG. 2, encircled numerals represent step numbers.

The cooling fan 15 provided exclusively for the radiator 12*a* and the oil cooler 12*b*, which are installed separately from the engine 11, is adapted to be driven by the hydraulic motor 32 or an electric motor. In cases where the temperature of the outside air, the temperature of the cooling water for the engine and the temperature of the hydraulic oil detected by the sensors 44,45,46 are respectively lower than the given temperatures Tai, Twa and Toi (YES in Step 1) when the engine 11 is started, the directional control solenoid valve 34 in the fan driving circuit 31 is maintained at the neutral position N for keeping the fan at a standstill (Step 2).

The temperature of the cooling water for the engine 11 normally increases to the appropriate level faster than the temperature of the hydraulic oil does. When the temperature of the cooling water has reached the predetermined appropriate temperature (Step 3), a thermostat opens and permits the cooling water to flow to the radiator 12*a*.

When the cooling water which has been warmed to or above the given temperature Twa reaches the radiator 12*a*, on condition that the temperature of the hydraulic oil is lower than the given temperature Toi, the controller 42 of the control device 41 shifts the directional control solenoid valve 34 or the change-over switch in the fan driving circuit 31 to the reverse position B in order to drive the cooling fan 15 in reverse (step 4).

As a result, the cooling air is introduced from the direction of the radiator 12*a*, flows through the oil cooler 12*b* and is discharged by the cooling fan 15 into the air passage 16 that is formed inside the construction machine.

At that time, as the warmed cooling water is flowing in the radiator 12*a*, the cooling air is warmed when it passes the radiator 12*a*. The warm air then flows to the oil cooler 12*b*, where it warms the hydraulic oil in the oil cooler 12*b*.

The warm air also warms the hydraulic equipment, such as the control valve 24 disposed in the air passage 16 in the machine, and, thereafter, is discharged through the air intake portion of the air passage 16 to the outside of the machine.

When the temperature of the hydraulic oil reaches or exceeds the given temperature Toi (Step 5), the controller 42 of the control device 41 operates so that the cooling fan 15 rotates again in the normal direction (Step 6). As a result, the cooling air is introduced from the air intake portion of the air passage 16 in the machine to the cooling fan 15, passes the oil cooler 12*b* and the radiator 12*a*, and is then discharged to the outside of the machine (Step 7).

In cases where any one of the temperatures of the outside air, the cooling water and the hydraulic oil is higher than the given temperature for stopping the fan or initially reverse rotation and still in the temperature range where reverse rotation is possible (NO in Step 1), the cooling fan 15 is driven in reverse for a given period of time (for a not so long period of time) immediately after the engine 11 is started. Thereafter, the controller 42 of the control device 41 automatically controls the directional control solenoid valve 34 to drive the cooling fan 15 forward (Step 8).

As a result, the air flowing in the reverse direction automatically cleans clogged portions of the oil cooler 12*b* and the radiator 12*a* at regular intervals.

The cooling fan 15 can be driven in reverse based on an arbitrary decision of the operator who is currently operating the construction machine and manually shifts the directional control solenoid valve 34 to the reverse position B by operating the manual switch 47. Therefore, cleaning of clogged portions can be conducted whenever conditions of the clogged portions or other circumstances require a cleaning.

As described above, by rotating the cooling fan 15 in reverse, debris lodged in the radiator 12*a* and the oil cooler 12*b* can be removed by means of back flow of the cooling air.

Based on the temperature of the outside air, the temperature of the cooling water and the temperature of the hydraulic oil, the control device 41 is capable of automatically shifting the fan driving circuit 31 of the cooling fan 15 to any one of the functions selected from among standstill, forward rotation and reverse rotation.

In addition, the fan driving circuit 31 of the cooling fan 15 can be shifted by a manual operation based on a decision of the operator of the construction machine equipped with a device according to the invention so that the cooling fan 15 may be driven in reverse depending on conditions of clogging in the radiator 12*a* and the oil cooler 12*b*.

The engine cooling water in the radiator 12*a* has a characteristic that it can be warmed more quickly with relative ease. Therefore, when the temperature of the hydraulic oil is low, the cooling fan 15 may be driven in reverse in order to make use of the aforementioned characteristic of the cooling water in the radiator for warming up the hydraulic oil in the oil cooler 12*b*, which is located downstream of the radiator 12*a* when the oil cooler is driven in reverse, so that the hydraulic equipment such as the control valve 24 is warmed up and that back flow of the cooling air removes debris lodged in the radiator 12*a* and the oil cooler 12*b*.

Furthermore, as the cooling fan 15 is rotated in reverse when the engine is started, reliable removal of debris lodged in the radiator 12*a* and the oil cooler 12*b* by using back flow of the cooling air is ensured.

INDUSTRIAL APPLICABILITY

Application of the present invention is not limited to a hydraulic excavator and a wheel loader; the invention is applicable to a cooling device for a variety of construction machine which has a radiator and an oil cooler that are subject to forced cooling by a cooling fan.

What is claimed is:

1. A cooling device for a construction machine, the construction machine having an engine, and a hydraulic circuit in which hydraulic oil circulates, the cooling device including:

a radiator for cooling an engine coolant flow, an oil cooler for cooling the hydraulic oil circulating in the hydraulic circuit, a cooling fan for blowing air onto said radiator and said oil cooler, the radiator and oil cooler being in line one with another and disposed in an air passage located separately from the engine and such that with respect to air blowing in a first direction in the air passage, the radiator is downstream of the oil cooler, and with respect to air blowing in an opposite direction in said air passage, the radiator is upstream of said oil cooler, said cooling fan having a forward rotation operation mode in which air is blown therewith in the first direction, a reverse rotation operation mode in which air is blown therewith in said opposite direction, and a further operation mode in which said cooling fan is stopped, an oil operated motor for driving the cooling fan, a control device comprising a three position change valve for effecting cut off and feed of oil to the oil operated motor, a first change valve position corresponding to cooling fan forward operation mode, a second change valve position corresponding to cooling fan reverse rotation operation mode, and a third position corresponding to said cooling fan further operation mode, a controller for controlling shifting of said three position change valve responsive to sensed respective ones of conditions of outside air temperature, engine coolant temperature, and hydraulic circuit hydraulic oil temperature, and a respective plurality of separate sensors connected to the controller for detecting the said respective ones of outside air temperature, engine coolant temperature, and hydraulic circuit hydraulic oil temperature conditions, said controller, on a start of the engine and where outside air temperature, engine coolant temperature, and hydraulic circuit hydraulic oil temperature are, respectively, lower than a given temperature of each, is effective to maintain the change valve in third position until engine coolant is warmed by engine operation to and above the given engine coolant temperature whereupon said controller further is effective to shift the change valve to second position for operating the cooling fan in reverse rotation operation mode so that cooling air warmed on passing the radiator is used to warm hydraulic circuit hydraulic oil in the oil cooler and to remove any debris lodged in the radiator and oil cooler.

2. A cooling device in accordance with claim 1 in which the controller is effective on warming of the hydraulic circuit hydraulic oil to and above the given hydraulic circuit hydraulic oil temperature to shift the change valve to first position for operating the cooling fan in forward rotation operation mode to cool the engine coolant and the hydraulic circuit hydraulic oil.

3. A cooling device in accordance with claim 1 in which the controller, on a start of the engine and where any one of outside air temperature, engine coolant temperature, and hydraulic circuit hydraulic oil temperature is higher than a given temperature for the cooling fan to be in its said further operation mode or be shiftable to reverse rotation operation mode, is effective to shift the change valve to second position for operating the cooling fan in reverse rotation operation mode for a given time period at the end of which the change valve is shifted to first position for operating the cooling fan in forward rotation operation mode.

4. A cooling device in accordance with claim 1 comprising user manually operated switch means on the controller operable for shifting the change valve to second change valve position from a other change valve position.

* * * * *